US008568178B2

(12) United States Patent
Inoue

(10) Patent No.: US 8,568,178 B2
(45) Date of Patent: Oct. 29, 2013

(54) MARINE VESSEL PROPULSION APPARATUS

(75) Inventor: Hiroshi Inoue, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 304 days.

(21) Appl. No.: 13/028,322

(22) Filed: Feb. 16, 2011

(65) Prior Publication Data

US 2011/0318977 A1 Dec. 29, 2011

(30) Foreign Application Priority Data

Jun. 23, 2010 (JP) ..... 2010-143143

(51) Int. Cl.
*B63H 21/21* (2006.01)
*B63H 21/38* (2006.01)

(52) U.S. Cl.
USPC ..... 440/1; 440/88 R

(58) Field of Classification Search
USPC .... 440/1, 88 R, 88 L, 88 C, 88 D, 88 M, 88 P
See application file for complete search history.

(56) References Cited

U.S. PATENT DOCUMENTS

| | | | | |
|---|---|---|---|---|
| 4,872,857 | A * | 10/1989 | Newman et al. | 440/1 |
| 5,494,467 | A | 2/1996 | Sohgawa et al. | |
| 6,015,319 | A | 1/2000 | Tanaka | |
| 6,102,755 | A | 8/2000 | Hoshiba | |
| 6,213,820 | B1 * | 4/2001 | Kanno | 440/1 |
| 6,810,724 | B2 * | 11/2004 | Kimata et al. | 73/114.28 |
| 7,766,708 | B2 * | 8/2010 | Akuzawa | 440/1 |
| 8,333,629 | B2 * | 12/2012 | McChesney et al. | 440/88 C |
| 2004/0203299 | A1 | 10/2004 | Kashima et al. | |
| 2008/0268726 | A1 | 10/2008 | Akuzawa | |

FOREIGN PATENT DOCUMENTS

| | | | |
|---|---|---|---|
| JP | 62-070646 | A | 4/1987 |
| JP | 62-085178 | A | 4/1987 |
| JP | 06-323142 | A | 11/1994 |
| JP | 06-330839 | A | 11/1994 |

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A marine vessel propulsion apparatus includes an engine, a rotation speed detecting device, a forward-reverse switching mechanism, a shift position detecting device, a liquid supplying device, a flow passage, a physical quantity detecting device, and a controller. The flow passage is arranged such that a liquid is supplied from the liquid supplying device when a crankshaft is rotating in one rotation direction. A physical quantity of the liquid in the flow passage after the forward-reverse switching mechanism has been switched from the forward drive state to the reverse drive state in a state where the crankshaft is rotating is a post-switching physical quantity. The controller executes a reverse rotation prevention control to control at least one of either the engine or the forward-reverse switching mechanism to prevent reverse rotation of the crankshaft in a case where the post-switching physical quantity is less than a predetermined first value.

10 Claims, 7 Drawing Sheets

MARINE VESSEL PROPULSION APPARATUS

BACKGROUND OF THE INVENTION

1. Field of the Invention

The present invention relates to a marine vessel propulsion apparatus.

2. Description of the Related Art

An outboard motor is an example of a marine vessel propulsion apparatus included in a marine vessel. A conventional outboard motor is described, for example, in U.S. Patent Application Publication No. 2008/0268726. The outboard motor includes an engine arranged to rotate a propeller, and an ECU (electronic control unit) arranged and programmed to control the outboard motor. The ECU drives the marine vessel forward and in reverse by making the engine rotate a propeller. The engine includes a crankshaft arranged to be capable of rotating, a camshaft arranged to rotate in linkage with the rotation of the crankshaft, a magnetic sensor arranged to detect a rotation angle of the crankshaft, and a magnetic sensor arranged to detect a rotation angle of the camshaft.

The engine rotates the crankshaft in one rotation direction to rotate the propeller. A rotation direction of the propeller is switched according to a shift position of the outboard motor. When the marine vessel is being driven forward in a normal state, the propeller rotates forward. When the marine vessel is being driven in reverse in a normal state, the propeller rotates in reverse. The crankshaft rotates in only the one direction and the rotation direction of the propeller is switched by switching a dog clutch provided between the crankshaft and a propeller shaft. However, when the shift position of the outboard motor is switched from a forward drive position to a reverse drive position in a state where the marine vessel is being driven forward at high speed, the crankshaft may rotate in reverse.

Specifically, immediately after the shift position of the outboardmotor is switched from the forward drive position to the reverse drive position in the state where the marine vessel is being driven forward at high speed, the marine vessel is driven forward by inertia and thus a resistance (water pressure) that makes the propeller rotate forward is applied to the propeller. The resistance is transmitted to the crankshaft. The shift position of the outboard motor at this point is the reverse drive position and thus the resistance that makes the propeller rotate forward is transmitted to the crankshaft as a force that makes the crankshaft rotate in reverse. The crankshaft may thus rotate in reverse when the shift position of the outboard motor is switched from the forward drive position to the reverse drive position in the state where the marine vessel is being driven forward at high speed.

When the crankshaft rotates in reverse, an interior of an exhaust passage connected to an exhaust port of the engine is put in a negative pressure state, and thus water, which is present outside the outboard motor and is sucked into the exhaust passage through an exit of the exhaust passage that opens at the propeller, may enter into an interior of the engine. Also, when the crankshaft rotates in reverse, a relationship between a rotation period of the crankshaft and a rotation period of the camshaft changes. In U.S. Patent Application Publication No. 2008/0268726, the ECU detects the reverse rotation of the crankshaft based on this relationship.

SUMMARY OF THE INVENTION

The inventor of preferred embodiments of the present invention described and claimed in the present application conducted an extensive study and research regarding a marine vessel propulsion apparatus, such as the one described above, and in doing so, discovered and first recognized new unique challenges and previously unrecognized possibilities for improvements as described in greater detail below.

Specifically, it is preferable that the reverse rotation of the crankshaft be detected instantly. However, with the outboard motor according to U.S. Patent Application Publication No. 2008/0268726, the rotation period of the crankshaft and the rotation period of the camshaft are detected after the crankshaft rotates in reverse and the reverse rotation of the crankshaft is detected based on the relationship of these periods. The reverse rotation of the crankshaft is thus detected after the crankshaft has rotated at least a few times in the reverse rotation direction. Thus, it takes time to detect the reverse rotation of the crankshaft. Further, it is difficult to detect a state immediately before the reverse rotation of the crankshaft occurs (a tendency for reverse rotation).

Such a phenomenon may occur not only in an outboard motor but also in an inboard motor, an inboard/outboard motor, or other type of marine vessel propulsion apparatus.

In order to overcome the previously unrecognized and unsolved challenges described above, a preferred embodiment of the present invention provides a marine vessel propulsion apparatus that includes an engine, a rotation speed detecting device, a forward-reverse switching mechanism, a shift position detecting device, a liquid supplying device, a flow passage, a physical quantity detecting device, and a controller. The engine includes a crankshaft arranged to be capable of rotating. The engine is arranged to rotate a propeller by rotating the crankshaft in one rotation direction. The rotation speed detecting device is arranged to detect a rotation speed of the crankshaft. The forward-reverse switching mechanism is arranged to transmit the rotation of the crankshaft to the propeller and is arranged to be switched among a forward drive state in which the propeller is rotated in a forward drive rotation direction, a reverse drive state in which the propeller is rotated in a reverse drive rotation direction, and a neutral state in which a transmission of rotation between the crankshaft and the propeller is cut off. The shift position detecting device is arranged to detect which state among the forward drive state, the reverse drive state, and the neutral state the forward-reverse switching mechanism is in. The liquid supplying device is arranged to be driven by the engine and to supply a liquid to the engine. The flow passage is arranged to be supplied with the liquid from the liquid supplying device when the crankshaft is rotating in the one rotation direction. The physical quantity detecting device is arranged to detect, in the flow passage, a physical quantity of the liquid supplied from the liquid supplying device to the flow passage. The controller is arranged to acquire detection values of the rotation speed detecting device, the shift position detecting device, and the physical quantity detecting device. The physical quantity of the liquid in the flow passage after the forward-reverse switching mechanism has been switched from the forward drive state to the reverse drive state in a state where the crankshaft is rotating is a post-switching physical quantity. The controller is arranged and programmed to execute a reverse rotation prevention control to control at least one of either the engine or the forward-reverse switching mechanism to prevent reverse rotation of the crankshaft in a case where the post-switching physical quantity is less than a predetermined first value.

With the arrangement of the present preferred embodiment, the engine rotates the crankshaft in one rotation direction. The rotation and rotation speed of the crankshaft are detected by the rotation speed detecting device. Also, the rotation of the crankshaft is transmitted to the propeller by the forward-reverse switching mechanism. The forward-reverse switching mechanism is switched among the forward drive state in which the propeller is rotated in the forward drive rotation direction, the reverse drive state in which the propeller is rotated in the reverse drive rotation direction, and the neutral state in which the rotation of the crankshaft is not transmitted to the propeller. The state of the forward-reverse switching mechanism is detected by the shift position detecting device.

Also, when the engine rotates the crankshaft in the one rotation direction, the liquid is supplied from the liquid supplying device to the flow passage. The physical quantity detecting device detects, in the flow passage, the physical quantity of the liquid supplied from the liquid supplying device to the flow passage. That is, the physical quantity detecting device detects, in the flow passage, a physical quantity of the liquid, including a pressure of the liquid, a flow rate of the liquid, and/or a flow velocity of the liquid. The controller detects the reverse rotation of the crankshaft based on the physical quantity of the liquid detected by the physical quantity detecting device. Specifically, the physical quantity of the liquid in the flow passage after the forward-reverse switching mechanism has been switched from the forward drive state to the reverse drive state in a state where the crankshaft is rotating is defined as the post-switching physical quantity, and a predetermined physical quantity of the liquid is defined as the predetermined first value. The controller executes the reverse rotation prevention control to control at least one of either the engine or the forward-reverse switching mechanism in the case where the post-switching physical quantity is less than the predetermined first value. The reverse rotation of the crankshaft is thereby prevented.

The liquid is supplied from the liquid supplying device to the flow passage when the crankshaft is rotating in the one rotation direction. The physical quantity of the liquid is thus less than the predetermined first value when the crankshaft is not rotating and when the crankshaft is rotating in reverse. Thus, when the rotation direction of the crankshaft changes from the one rotation direction to another rotation direction (direction opposite to the one rotation direction), the physical quantity of the liquid in the flow passage changes from a value not less than the predetermined first value to a value less than the predetermined first value. The controller can thus detect a state immediately before the reverse rotation of the crankshaft (a tendency for reverse rotation) based on the physical quantity of the liquid in the flow passage. Also, the physical quantity of the liquid decreases before the reverse rotation of the crankshaft begins, and thus the controller can immediately detect the reverse rotation of the crankshaft based on the physical quantity of the liquid in the flow passage.

The physical quantity detecting device may include a liquid pressure detecting device arranged to detect, in the flow passage, the pressure of the liquid supplied from the liquid supplying device to the flow passage. The post-switching physical quantity may include a post-switching liquid pressure, which is the pressure of the liquid in the flow passage after the forward-reverse switching mechanism has been switched from the forward drive state to the reverse drive state in the state where the crankshaft is rotating. The predetermined first value may include a predetermined first liquid pressure.

In this case, the liquid supplying device may include an oil supplying device arranged to supply oil by being driven by the engine. Further, the liquid pressure detecting device may include an oil pressure detecting device arranged to detect, in the flow passage, a pressure of the oil supplied from the oil supplying device to the flow passage. Further, the post-switching liquid pressure may include a post-switching oil pressure, which is the pressure of the oil in the flow passage after the forward-reverse switching mechanism has been switched from the forward drive state to the reverse drive state in the state where the crankshaft is rotating. The predetermined first value may include a predetermined first oil pressure.

Also, the liquid supplying device may include a water supplying device arranged to be driven by the engine and to supply water to the engine. Further, the liquid pressure detecting device may include a water pressure detecting device arranged to detect, in the flow passage, a pressure of the water supplied from the water supplying device to the flow passage. Further, the post-switching liquid pressure may include a post-switching water pressure, which is the pressure of the water in the flow passage after the forward-reverse switching mechanism has been switched from the forward drive state to the reverse drive state in the state where the crankshaft is rotating, and the predetermined first value may include a predetermined first water pressure.

Also, the first oil pressure is preferably a minimum value of the oil pressure in the flow passage when the flow passage is filled with the oil. That is, for example, immediately after starting of the engine, etc., an engine speed is extremely low and thus the flow passage may not be filled with the oil and the oil pressure in the flow passage may be extremely low. Also, in this case, the oil pressure in the flow passage may not correspond to the engine speed. On the other hand, when the flow passage is filled with oil, an oil pressure that corresponds to the engine speed is generated in the flow passage. Thus, when the crankshaft is rotating in reverse or immediately before the crankshaft rotates in reverse, the oil pressure in the flow passage is less than the minimum value of the oil pressure in the flow passage when the flow passage is filled with oil. Thus, in the case where the first oil pressure is the minimum value of the oil pressure in the flow passage when the flow passage is filled with the oil, the controller can reliably detect the tendency for reverse rotation as well as the reverse rotation of the crankshaft.

Also, the flow passage may include a discharge port from which the oil supplied from the oil supplying device is discharged, and the oil pressure detecting device may be arranged to detect the oil pressure between the oil supplying device and the discharge port. That is, the flow passage is preferably a flow passage that connects the oil supplying device and the discharge port. The flow passage is preferably a flow passage other than a flow passage leading from an oil retaining portion (for example, an oil pan) that retains oil to the oil supplying device or a flow passage that returns the oil, which remains without being discharged from the discharge port, to the oil retaining portion.

Also, the controller may be arranged and programmed to execute the reverse rotation prevention control in a case where a pre-switching physical quantity, which is the physical quantity of the liquid in the flow passage when the forward-reverse switching mechanism is in the forward drive state or the neutral state and the crankshaft is rotating, is not less than the predetermined first value and the post-switching physical quantity is less than the predetermined first value.

The crankshaft may rotate in reverse when the forward-reverse switching mechanism is switched from the forward drive state to the reverse drive state in the state where the marine vessel is being driven forward at high speed. That is, ordinarily, the reverse rotation of the crankshaft occurs after the forward-reverse switching mechanism has been switched from the forward drive state to the reverse drive state. The reverse rotation of the crankshaft thus does not occur when the forward-reverse switching mechanism is in the forward drive state or the neutral state. The pre-switching physical quantity, which is the physical quantity of the liquid in the flow passage when the forward-reverse switching mechanism is in the forward drive state or the neutral state and the crankshaft is rotating, is thus not less than the predetermined first value. Thus, when the pre-switching physical quantity is less than the predetermined first value, an abnormality may be occurring in at least one component among the physical quantity detecting device, the liquid supplying device, and/or the flow passage. The controller executes the reverse rotation prevention control in the case where the pre-switching physical quantity is not less than the predetermined first value and the post-switching physical quantity is less than the predetermined first value. The post-switching physical quantity can thus be prevented from being judged, due to an abnormality of the physical quantity detecting device, etc., to be less than the predetermined first value even though the actual post-switching physical quantity is not less than the predetermined first value.

Also, the controller may include a timer arranged to measure time and the controller is arranged and programmed to execute the reverse rotation prevention control only when an elapsed time from the switching of the forward-reverse switching mechanism from the forward drive state to the reverse drive state is not more than a predetermined time.

With the arrangement of the present preferred embodiment, the controller measures, by the timer, the time from the switching of the forward-reverse switching mechanism from the forward drive state to the reverse drive state. The controller executes the reverse rotation prevention control only when the elapsed time from the switching of the forward-reverse switching mechanism from the forward drive state to the reverse drive state is not more than the predetermined time. The reverse rotation prevention control is thus not performed after the predetermined time has elapsed from the switching of the forward-reverse switching mechanism to the reverse drive state. The reverse rotation prevention control can thus be prevented from being executed erroneously even when, due to some reason, the physical quantity of the liquid (for example, the oil pressure) decreases during ordinary running of the marine vessel (when the marine vessel is being driven forward or driven in reverse at a predetermined speed).

Also, the liquid supplying device may be arranged such that the flow rate of the liquid supplied into the flow passage increases with an increase in the rotation speed of the crankshaft. In this case, the controller may be arranged and programmed to execute the reverse rotation prevention control in a case where, after the forward-reverse switching mechanism has been switched from the forward drive state to the reverse drive state, the rotation speed of the crankshaft is increasing and the post-switching physical quantity is less than the predetermined first value.

With this arrangement of the present preferred embodiment, when the engine is in the state of rotating the crankshaft in the one rotation direction, the rotation speed of the crankshaft increases, the flow rate of the liquid supplied from the liquid supplying device into the flow passages increases and the pressure and the flow velocity of the liquid in the flow passage increase. That is, the physical quantity of the liquid increases. Thus, if the crankshaft is not rotating in reverse, the post-switching physical quantity increases when the rotation speed of the crankshaft increases after the forward-reverse switching mechanism has been switched from the forward drive state to the reverse drive state. That is, in the case where the crankshaft is rotating in reverse, the post-switching physical quantity is less than the predetermined first value even when the rotation speed of the crankshaft increases after the forward-reverse switching mechanism has been switched from the forward drive state to the reverse drive state. The controller detects the reverse rotation of the crankshaft based on the rotation speed of the crankshaft in addition to the physical quantity of the liquid. The reverse rotation of the crankshaft can thereby be detected more reliably.

Also, the reverse rotation prevention control may include a shift control to control the forward-reverse switching mechanism to switch the forward-reverse switching mechanism from the reverse drive state to the neutral state. That is, the controller may be arranged to execute the shift control in the case where the post-switching physical quantity is less than the predetermined first value.

With this arrangement of the present preferred embodiment, the controller controls the forward-reverse switching mechanism and executes the shift control upon detection of reverse rotation of the crankshaft. The forward-reverse switching mechanism is thereby switched from the reverse drive state to the neutral state and the transmission of rotation between the crankshaft and the propeller is cut off. The force applied to the propeller (the force that causes the crankshaft to rotate in reverse) is thus prevented from being transmitted to the crankshaft. The reverse rotation of the crankshaft is thereby prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
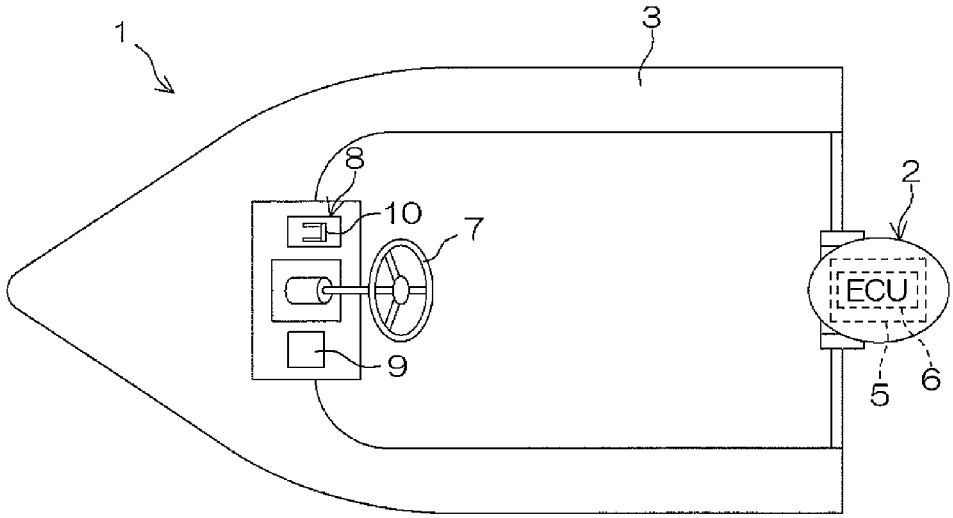
FIG. 1 is a schematic diagram for explaining an arrangement of a marine vessel according to a preferred embodiment of the present invention.
Figure 2:
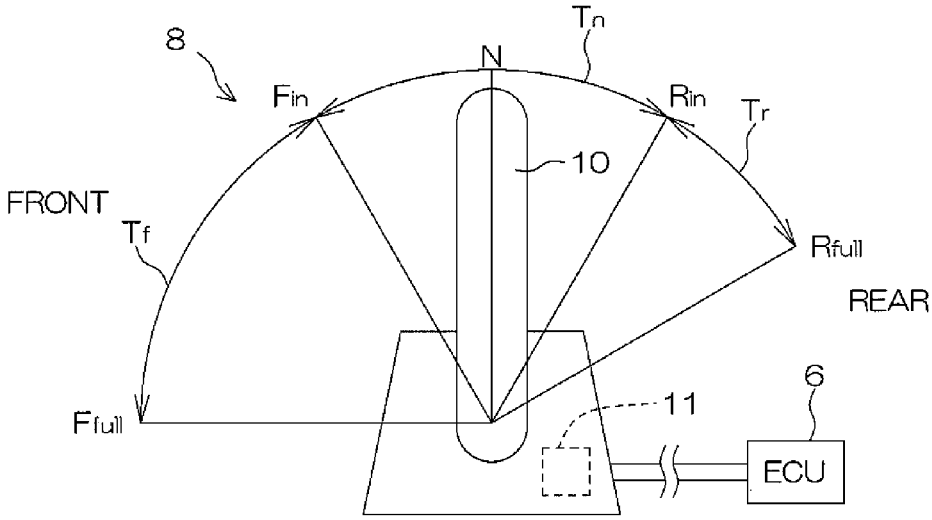
FIG. 2 is a side view of a remote control box according to a preferred embodiment of the present invention.

FIG. 1 is a schematic diagram for explaining an arrangement of a marine vessel 1 according to a preferred embodiment of the present invention. FIG. 2 is a side view of a remote control box 8 according to a preferred embodiment of the present invention.

As shown in FIG. 1, the marine vessel 1 includes an outboard motor 2 and a hull 3. The outboard motor 2 is an example of a marine vessel propulsion apparatus. The outboard motor 2 is attached to a rear portion of the hull 3. The outboard motor 2 generates a propulsive force that propels the hull 3. The outboard motor 2 includes an engine 5 that rotates a propeller 4 (see FIG. 3) and an ECU 6 (electronic control unit) that controls the outboard motor 2. The hull 3 includes a steering member 7, the remote control box 8, and a display portion 9. The marine vessel 1 is steered by operating the steering member 7. Also, a speed of the marine vessel 1 is adjusted by operating a lever 10 included in the remote control box 8. Switching between forward drive and reverse drive of the marine vessel 1 is performed by operating the lever 10. The speed and other conditions of the marine vessel 1 are displayed on the display portion 9.

As shown in FIG. 2, the lever 10 of the remote control box 8 is pivotable to the front and rear about a lower end portion thereof. The lever 10 is inclined by a marine vessel operator to the front and rear with a position at which the lever 10 is substantially vertical as a center. A neutral position N is, for example, the position at which the lever 10 is substantially vertical. When the lever 10 is inclined to the front from the neutral position N to a forward drive shift-in position Fin, the outboard motor 2 generates a propulsive force in a forward drive direction that drives the hull 3 forward. When the lever 10 is inclined to the rear from the neutral position N to a reverse drive shift-in position Rin, the outboardmotor 2 generates a propulsive force in a reverse drive direction that drives the hull 3 in reverse. A region between the forward drive shift-in position Fin and the reverse drive shift-in position Rin is a neutral region Tn in which the generation of propulsive force from the outboard motor 2 is stopped.

Also, when the lever 10 is inclined further to the front from the forward drive shift-in position Fin toward a forward drive fully-open position Ffull, the propulsive force in the forward drive direction increases in accordance with an inclination amount of the lever 10. Likewise, when the lever 10 is inclined further to the rear from the reverse drive shift-in position Rin toward a reverse drive fully-open position Rfull, the propulsive force in the reverse drive direction increases in accordance with the inclination amount of the lever 10. As shown in FIG. 2, a region from the forward drive shift-in position Fin to the forward drive fully-open position Ffull is a forward drive output adjustment region Tf. Also, a region from the reverse drive shift-in position Rin to the reverse drive fully-open position Rfull is a reverse drive output adjustment region Tr.

The remote control box 8 is electrically connected to the ECU 6. As shown in FIG. 2, the remote control box 8 includes a position detecting device 11 that detects an operation position of the lever 10. For example, when the lever 10 is moved from the neutral position N to the forward drive shift-in position Fin, a command for switching the shift position of the outboard motor 2 from a neutral position to a forward drive position is input into the ECU 6. The shift position of the outboard motor 2 is thereby switched to the forward drive position by the ECU 6 and the hull 3 is propelled forward. Also, when the lever 10 is inclined from the forward drive shift-in position Fin toward the forward drive fully open position Ffull, a command for increasing the output of the engine 5 is input into the ECU 6 and the marine vessel 1 is accelerated.

Figure 3:
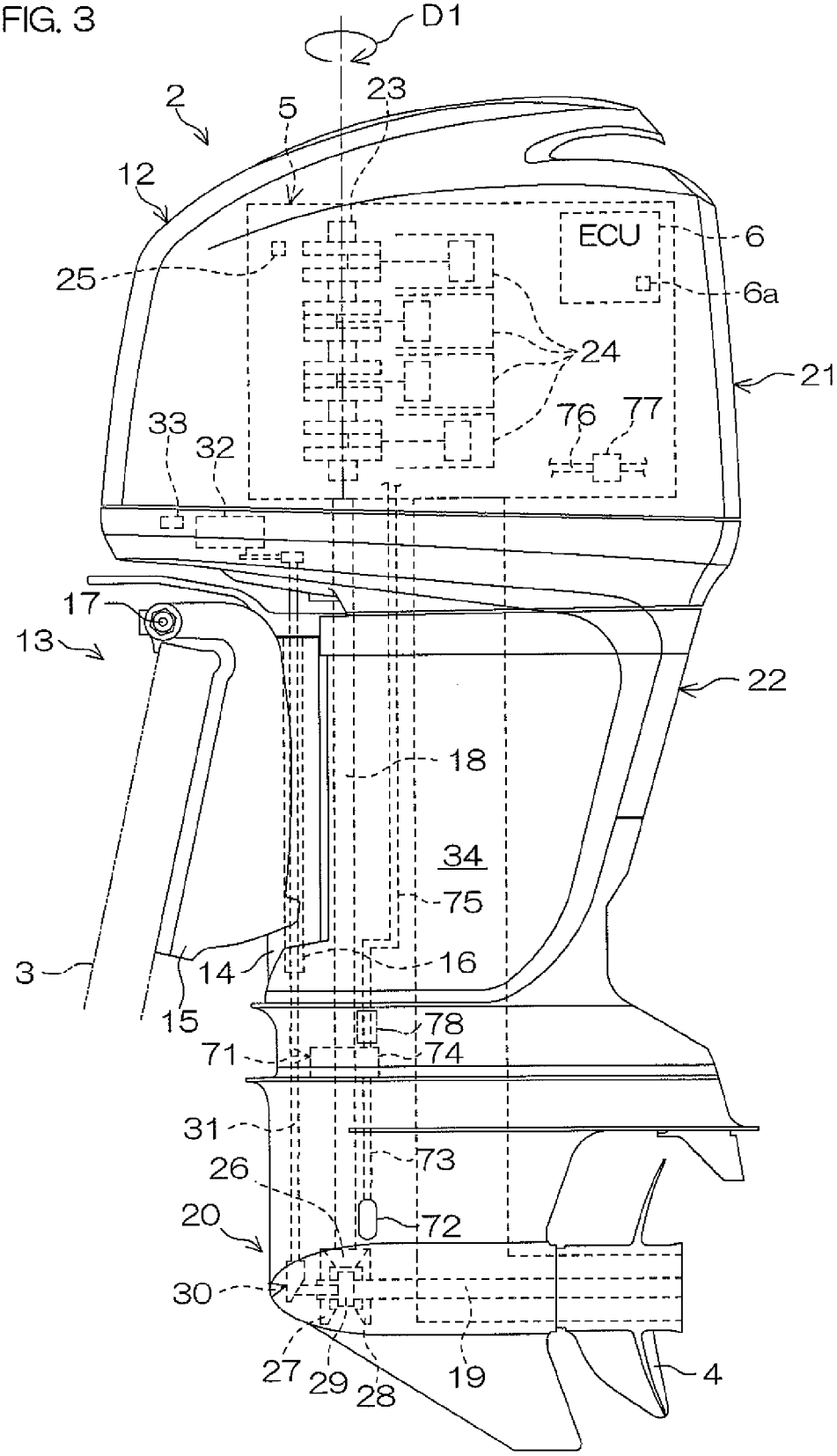
FIG. 3 is a side view of an outboard motor according to a preferred embodiment of the present invention.

FIG. 3 is a side view of the outboard motor 2 according to a preferred embodiment of the present invention.

The outboard motor 2 includes an outboard motor main body 12 and an attachment mechanism 13. The outboard motor main body 12 is attached to a rear portion of the hull 3 by the attachment mechanism 13. The attachment mechanism 13 includes a swivel bracket 14, a clamp bracket 15, a steering shaft 16, and a tilt shaft 17. The steering shaft 16 is disposed so as to extend vertically. The tilt shaft 17 is disposed horizontally so as to extend to the right and left. The swivel bracket 14 is coupled to the outboard motor main body 12 via the steering shaft 16. Also, the clamp bracket 15 is coupled to the swivel bracket 14 via the tilt shaft 17. The clamp bracket 15 is fixed to a rear portion of the hull 3.

The outboardmotor main body 12 is attached in a substantially vertical orientation to the hull 3 by the attachment mechanism 13. The outboard motor main body 12 and swivel bracket 14 are pivotable up and down about the tilt shaft 17 with respect to the clamp bracket 15. The outboard motor main body 12 is inclined with respect to the hull 3 and the clamp bracket 15 by being pivoted about the tilt shaft 17. Also, the outboard motor main body 12 is pivotable to the right and left about the steering shaft 16 with respect to the swivel bracket 14 and the clamp bracket 15. The outboard motor main body 12 is pivoted to the right and left about the steering shaft 16 by operating the steering member 7 (see FIG. 1). The marine vessel 1 is thereby steered.

The outboard motor main body 12 includes a driveshaft 18, a propeller shaft 19, and a forward-reverse switching mechanism 20. The outboard motor main body 12 also includes an engine cover 21 and a casing 22. The engine 5 is housed inside the engine cover 21. The driveshaft 18 extends vertically inside the engine cover 21 and the casing 22. The propeller shaft 19 extends to the front and rear inside a lower portion of the casing 22. An upper end portion of the driveshaft 18 is coupled to the engine 5. Also, a lower end portion of the driveshaft 18 is coupled to a front end portion of the propeller shaft 19 by the forward-reverse switching mechanism 20. A rear end portion of the propeller shaft 19 protrudes rearward from the casing 22. The propeller 4 is coupled to the rear end portion of the propeller shaft 19. The propeller 4 rotates together with the propeller shaft 19. The propeller 4 is driven to rotate by the engine 5.

The engine 5 is, for example, an internal combustion engine that generates power by combustion of a fuel, such as gasoline. The engine 5 includes a crankshaft 23, a plurality (for example, four) of cylinders 24, and a rotation speed detecting device 25. The engine 5 is disposed so that the crankshaft 23 extends vertically. The upper end portion of the driveshaft 18 is coupled to a lower end portion of the crankshaft 23. The crankshaft 23 is rotatable about a vertical axis. The crankshaft 23 is driven to rotate in one rotation direction D1 by the combustion in the respective cylinders 24. A rotation speed of the crankshaft 23 (engine speed of the engine 5) is detected by the rotation speed detecting device 25. A detection value of the rotation speed detecting device 25 is input into the ECU 6.

The forward-reverse switching mechanism 20 includes a drive gear 26, a forward drive gear 27, a reverse drive gear 28, a dog clutch 29, and a shift mechanism 30. The drive gear 26, the forward drive gear 27, and the reverse drive gear 28 are, for example, cylindrical bevel gears. The drive gear 26 is coupled to the lower end portion of the driveshaft 18. The forward drive gear 27 and the reverse drive gear 28 are engaged with the drive gear 26. The forward drive gear 27 and the reverse drive gear 28 are disposed so that teeth portions oppose each other across an interval in a front/rear direction. Each of the forward drive gear 27 and the reverse drive gear 28 surrounds a front end portion of the propeller shaft 19. When a rotation of the drive gear 26 is transmitted to the forward drive gear 27 and the reverse drive gear 28, the forward drive gear 27 and the reverse drive gear 28 rotate in mutually opposite directions.

The dog clutch 29 is disposed between the forward drive gear 27 and the reverse drive gear 28. The dog clutch 29 is, for example, cylindrical. The dog clutch 29 surrounds the front end portion of the propeller shaft 19. The dog clutch 29 is coupled to the front end portion of the propeller shaft 19, for example, by a spline engagement. The dog clutch 29 thus rotates together with the front end portion of the propeller shaft 19. Also, the dog clutch 29 is movable in an axial direction with respect to the front end portion of the propeller shaft 19. The dog clutch 29 is moved in the axial direction of the propeller shaft 19 by the shift mechanism 30.

The shift mechanism 30 includes, for example, a vertically-extending shift rod 31, a shift actuator 32 coupled to an upper end portion of the shift rod 31, and a shift position detecting device 33 that detects a shift position of the dog clutch 29. The shift actuator 32 is controlled by the ECU 6. Also, a detection value of the shift position detecting device 33 is input into the ECU 6. The dog clutch 29 is moved in the axial direction of the propeller shaft 19 by the shift rod 31 being pivoted by the shift actuator 32. The dog clutch 29 is positioned at a shift position among a forward drive position, a reverse drive position, and a neutral position.

The forward drive position is a position at which the dog clutch 29 is engaged with the forward drive gear 27, and the reverse drive position is a position at which the dog clutch 29 is engaged with the reverse drive gear 28. Also, the neutral position is a position at which the dog clutch 29 is not engaged with either of the gears (the forward drive gear 27 and the reverse drive gear 28). The neutral position is a position between the forward drive position and the reverse drive position. In the state where the dog clutch 29 is positioned at the forward drive position, a rotation of the driveshaft 18 is transmitted to the propeller shaft 19 via the forward drive gear 27. Also, in the state where the dog clutch 29 is positioned at the reverse drive position, the rotation of the driveshaft 18 is transmitted to the propeller shaft 19 via the reverse drive gear 28. Also, in the state where the dog clutch 29 is positioned at the neutral position, the rotation of the driveshaft 18 is not transmitted to the propeller shaft 19.

When the rotation of the driveshaft 18 is transmitted to the propeller shaft 19 via the forward drive gear 27, the propeller 4 rotates in a forward drive rotation direction. A propulsive force in the forward drive direction is thereby generated. Also, when the rotation of the driveshaft 18 is transmitted to the propeller shaft 19 via the reverse drive gear 28, the propeller 4 rotates in the reverse drive rotation direction, which is opposite to the forward drive rotation direction. A propulsive force in the reverse drive direction is thereby generated. The rotation direction of the propeller 4 is thus switched by switching of the shift position of the dog clutch 29. The rotation direction of the propeller 4 is switched by operating the lever 10 of the remote control box 8.

The outboard motor main body 12 includes an exhaust passage 34 provided in an interior of the outboard motor main body 12. The exhaust passage 34 includes an exhaust entrance connected to the engine and an exhaust exit connected to the propeller 4. In a state where the marine vessel 1 is floating on water, the exit of the exhaust passage 34 is positioned underwater. Thus, in the state where the marine vessel 1 is floating on water, water that has passed through the exit of the exhaust passage 34 enters into a downstream portion of the exhaust passage 34. For example, when the engine 5 is rotating at high speed, the water inside the exhaust passage 34 is pushed by the pressure of the exhaust discharged from the engine 5 and is discharged along with the exhaust from the exit of the exhaust passage 34. The exhaust generated in the engine 5 is thereby discharged underwater.

The outboard motor main body 12 includes a cooling device 71. The cooling device 71 takes water from outside the outboard motor 2 as cooling water into the outboard motor main body 12 and supplies the water to the engine 5. The engine 5 is thereby cooled. The cooling device 71 includes a water intake port 72 opening at an outer surface of the casing 22, a first cooling water flow passage 73 connected to the water intake port 72, a water pump 74 connected to the water intake port 72 via the first cooling water flow passage 73, and a second cooling water flow passage 75 connected to the water pump 74. The cooling device 71 also includes a water jacket 76 provided in the engine 5 and connected to the second cooling water flow passage 75, and a water pressure detecting device 77 that detects a water pressure in the water jacket 76. The water pump 74 is disposed inside the casing 22, and the water jacket 76 is connected to the exhaust passage 34.

The water pump 74 is coupled, for example, to the driveshaft 18. The water pump 74 is, for example, a rotary pump that includes a rubber impeller coupled to the driveshaft 18 and a pump body that houses the impeller. The water pump 74 is driven by the engine 5. When the crankshaft 23 is rotating in the one rotation direction D1, the water pump 74 sucks in water from outside the outboard motor 2 at a flow rate corresponding to the engine speed of the engine 5 (rotation speed of the crankshaft 23). The water pump 74 supplies the water taken in from the water intake port 72 to the water jacket 76 via the first cooling water flow passage 73, the water pump 74, and the second cooling water flow passage 75. The engine 5 is thereby cooled. The water supplied to the water jacket 76 is discharged from the exit of the exhaust passage 34 along with the exhaust.

The cooling water is supplied from the water pump 74 to the water jacket 76 at the flow rate corresponding to the engine speed of the engine 5. That is, when engine speed of the engine 5 increases, the flow rate of the cooling water supplied to the water jacket 76 increases. When the cooling water is supplied at a predetermined flow rate to the water jacket 76 by the water pump 74, the water jacket 76 is filled with the cooling water. In this state, a water pressure corresponding to the engine speed of the engine 5 is generated in the water jacket 76. The water pressure detecting device 77 detects the water pressure in the water jacket 76. The water pressure detected by the water pressure detecting device 77 is input into the ECU 6.

Figure 4:
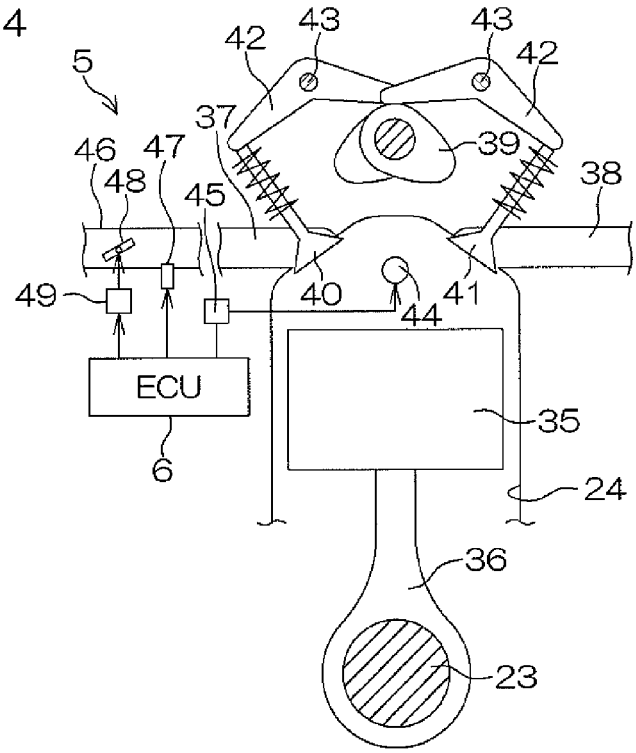
FIG. 4 is a schematic view of an engine according to a preferred embodiment of the present invention.

FIG. 4 is a schematic view of the engine 5 according to a preferred embodiment of the present invention.

The engine 5 includes a plurality of pistons 35 respectively disposed in the plurality of cylinders 24, a plurality of connecting rods 36 respectively coupling the plurality of pistons 35 to the crankshaft 23, and intake ports 37 and exhaust ports 38 provided respectively for each cylinder 24. When the crankshaft 23 is driven to rotate in the one rotation direction D1 by combustion in the respective cylinders 24, the rotation of the crankshaft 23 is transmitted to a camshaft 39. A pair of rocker arms 42, respectively corresponding to an intake valve 40 and an exhaust valve 41, are then pivoted about rocker arm shafts 43 by the rotation of the camshaft 39. The intake port 37 and the exhaust port 38 are thereby opened and closed at predetermined timings by the corresponding intake valve 40 and exhaust valve 41, respectively.

The engine 5 includes a plurality of spark plugs 44, respectively attached to the plurality of cylinders 24, and a plurality of ignition coils 45, respectively connected to the plurality of spark plugs 44. The engine 5 also includes a plurality of intake pipes 46, respectively connected to the plurality of cylinders 24, and fuel injectors 47 and throttle valves 48 provided in the respective intake pipes 46. The ECU 6 makes each ignition coil 45 generate a high voltage. The high voltage is thereby applied to the corresponding spark plug 44 and a spark is generated in the corresponding cylinder 24. A mixed gas of fuel and air is thus combusted inside each cylinder 24. The mixed gas is supplied from each intake pipe 46 into the corresponding cylinder 24. The ECU 6 controls a valve actuator 49 to change an opening degree of each throttle valve 48 to thereby adjust a supply flow rate of the mixed gas into the corresponding cylinder 24. Also, the ECU 6 controls the opening degree of the throttle valve 48 and an injection amount of fuel injected from the fuel injector 47 to adjust an air-fuel ratio.

Figure 5:
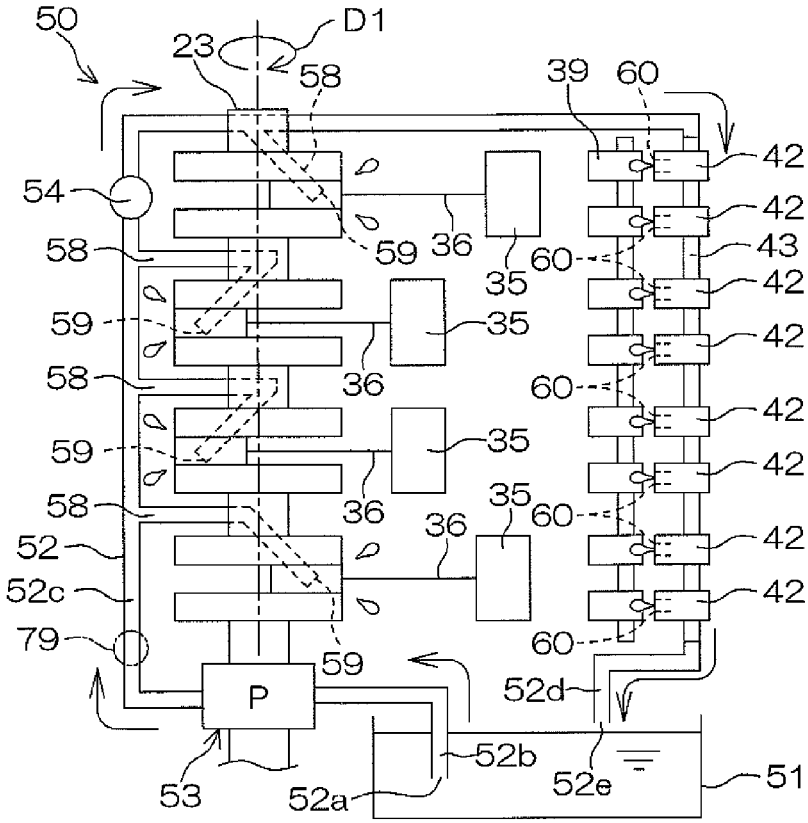
FIG. 5 is a schematic view of a lubricating device according to a preferred embodiment of the present invention.
Figure 6:
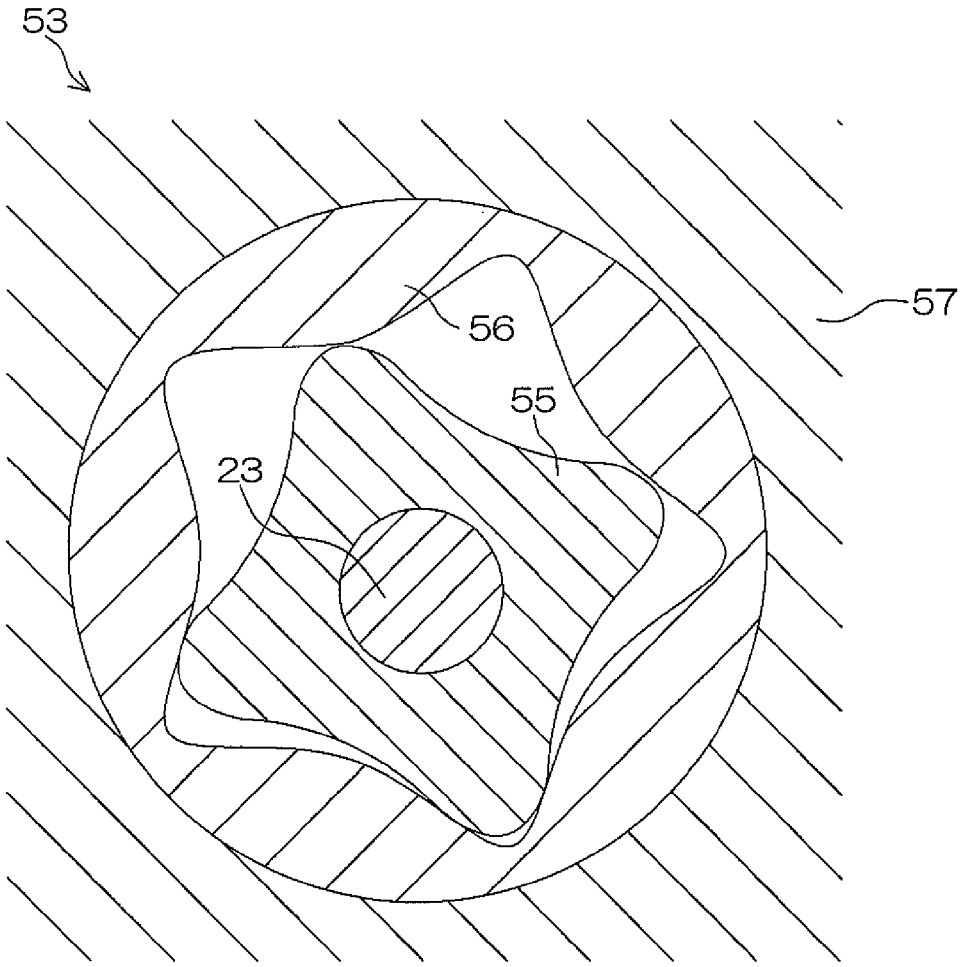
FIG. 6 is a sectional view of an oil pump according to a preferred embodiment of the present invention.

FIG. 5 is a schematic view of a lubricating device 50 according to a preferred embodiment of the present invention. FIG. 6 is a sectional view of an oil pump 53 according to a preferred embodiment of the present invention.

The outboard motor 2 includes the lubricating device 50. The engine 5 is lubricated by the lubricating device 50. The lubricating device 50 includes an oil pan 51, in which oil (lubricating oil) is retained, a lubricating flow passage 52 provided inside the engine 5, an oil pump 53 supplying the oil retained in the oil pan 51 to the lubricating flow passage 52, and an oil pressure detecting device 54 that detects an oil pressure in the lubricating flow passage 52. The oil pressure detecting device 54 is a device for notifying a user that oil is not supplied to the lubricating flow passage 52 due to a low supply of oil, clogging of an oil filter, etc., and thereby notifying that the engine 5 will be damaged if operation of the marine vessel 1 is continued as it is. The oil pressure detecting device 54 is thus ordinarily provided in the outboard motor 2.

The oil pump 53 is coupled, for example, to the lower end portion of the crankshaft 23. The oil pump 53 is driven together with the rotation of the crankshaft 23. As shown in FIG. 6, the oil pump 53 is, for example, a trochoid pump that includes an inner rotor 55 coupled to the crankshaft 23, an outer rotor 56 surrounding the inner rotor 55, and a housing 57 housing the inner rotor 55 and the outer rotor 56. The oil pump 53 is not restricted to a trochoid pump and may be a pump of another type, such as a gear pump, a rotary pump, etc.

The lubricating flow passage 52 is connected to the oil pan 51, the oil pump 53, the crankshaft 23, and the rocker arm shafts 43. The lubricating flow passage 52 extends from the oil pan 51 to the oil pump 53, and further passes through interiors of the oil pump 53 and the rocker arm shafts 43 and leads back to the oil pan 51. The lubricating flow passage 52 includes a plurality of branch flow passages 58 connected to the crankshaft 23. A portion of the branch flow passages may be provided inside the crankshaft 23. A discharge port 59 is provided at an end of each branch flow passage 58. Also, a plurality of discharge ports 60 are provided in the rocker arms 42. The oil inside the oil pan 51 is supplied to the lubricating flow passage 52 by the oil pump 53. The oil supplied to the lubricating flow passage 52 is discharged from the respective discharge ports 59 and 60.

Specifically, the oil pump 53 is arranged to supply a fluid in a direction corresponding to the rotation direction of the crankshaft 23. When the crankshaft 23 rotates in the one rotation direction D1, the oil inside the oil pan 51 is sucked in by the oil pump 53 from an entrance 52*a* of the lubricating flow passage 52 and supplied to the lubricating flow passage 52. The oil supplied to the lubricating flow passage 52 is discharged from the respective discharge ports 59 and 60 provided in the crankshaft 23 and the rocker arms 42. The engine 5 is thereby lubricated. On the other hand, when the crankshaft 23 rotates in reverse by rotating in a direction opposite to the one rotation direction D1, only air is sucked in from the respective discharge ports 59 and 60 by the oil pump 53 and the oil in the oil pan 51 is not supplied to the lubricating flow passage 52. Thus, oil is supplied to the lubricating flow passage 52 and an oil pressure is generated in the lubricating flow passage 52 in the case where the crankshaft 23 is driven to rotate in the one rotation direction D1.

The oil pressure in the lubricating flow passage 52 is detected by the oil pressure detecting device 54. A detection value of the oil pressure detecting device 54 is input into the ECU 6. A flow rate of the oil supplied from the oil pump 53 to the lubricating flow passage 52 increases with an increase in the engine speed of the engine 5. The oil pressure of the lubricating flow passage 52 thus increases with the increase in the engine speed of the engine 5. On the other hand, when the crankshaft 23 is rotating in reverse or the crankshaft 23 is not rotating, the oil in the oil pan 51 is not supplied to the lubricating flow passage 52 by the oil pump 53. Thus, when the crankshaft 23 is rotating in reverse, the oil pressure in the lubricating flow passage 52 does not vary according to the engine speed of the engine 5.

The lubricating flow passage 52 includes a first flow passage 52*b* connecting the entrance 52*a* and the oil pump 53, a second flow passage 52*c* connecting the oil pump 53 and the respective discharge ports 59 and 60, and a third flow passage 52*d* guiding the oil, which is not discharged from the respective discharge ports 59 and 60, to the oil pan 51. The oil in the oil pan 51 is supplied to the second flow passage 52*c* via the first flow passage 52*b*. The oil supplied to the second flow passage 52*c* is discharged from the respective discharge ports 59 and 60. The oil remaining without being discharged from the respective discharge ports 59 and 60 is supplied to the third flow passage 52*d*, discharged from an exit 52*e* of the lubricating flow passage 52, and returned to the oil pan 51. The oil pressure detecting device 54 detects the oil pressure in the second flow passage 52*c*.

When the engine 5 is rotating at an engine speed not less than a minimum engine speed, the second flow passage 52*c* is filled with the oil supplied from the oil pump 53. Thus, in this state, the oil pressure corresponding to the engine speed of the engine 5 is generated in the second flow passage 52*c*. On the other hand, when the engine speed of the engine 5 is extremely low (lower than the minimum engine speed), for example, as in immediately after starting of the engine 5, the flow rate of the oil supplied to the second flow passage 52*c* is low and the second flow passage 52*c* is not filled with oil. When the crankshaft 23 is rotating in the one rotation direction D1 at the minimum rotation speed, the second flow passage 52*c* is filled with oil and a minimum oil pressure Pmin is generated in the second flow passage 52*c*. That is, the minimum oil pressure Pmin is the oil pressure in the second flow passage 52*c* when the crankshaft 23 is rotating in the one rotation direction D1 at the minimum rotation speed.

Figure 7:
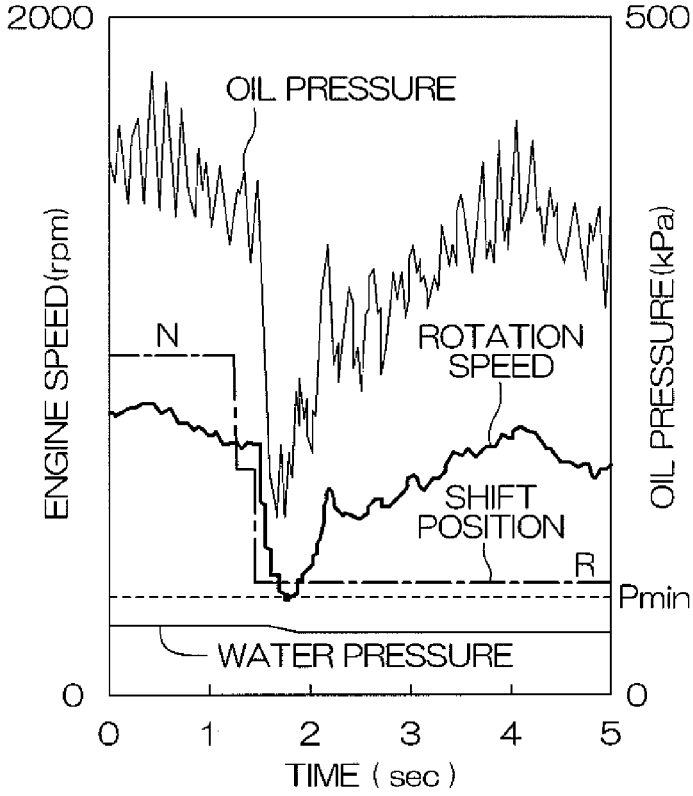
FIG. 7 is a graph of a case where reverse rotation of the crankshaft is not occurring.
Figure 8:
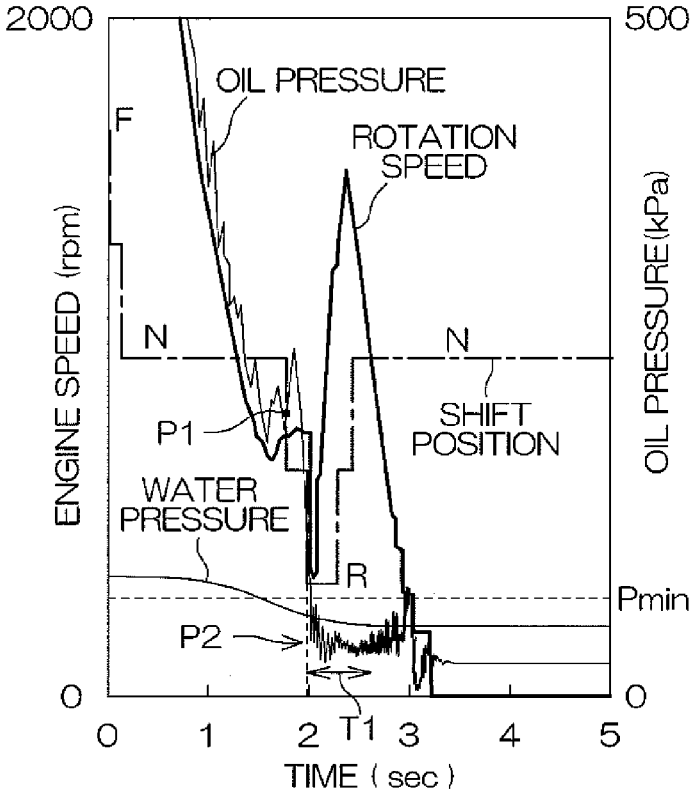
FIG. 8 is a graph of a case where reverse rotation of the crankshaft is occurring.

FIG. 7 is a graph of a case where reverse rotation of the crankshaft 23 is not occurring, and FIG. 8 is a graph of a case where reverse rotation of the crankshaft 23 is occurring. The graph of FIG. 7 shows measurement values of the engine speed of the engine 5 and the oil pressure in the lubricating flow passage 52 (oil pressure in the second flow passage 52*c*) when, in a state where the marine vessel 1 is being driven forward, the shift position (shift position of the dog clutch 29) is switched from the forward drive position to the reverse drive position without the crankshaft 23 of the engine 5 of the outboard motor 2 rotating in reverse. Also, the graph of FIG. 8 shows measurement values of the engine speed of the engine 5 and the oil pressure in the lubricating flow passage 52 (oil pressure in the second flow passage 52*c*) when the shift position of the outboard motor 2 is switched from the forward drive position to the reverse drive position in a state where the marine vessel 1 is being driven forward at high speed. "F," "N," and "R" in FIG. 7 and FIG. 8 indicate the forward drive position, the neutral position, and the reverse drive position, respectively.

When in the state where the marine vessel 1 is being driven forward, the lever 10 of the remote control box 8 is moved from the forward drive output adjustment region Tf to the reverse drive output adjustment region Tr, the dog clutch 29 is moved from the forward drive position to the reverse drive position via the neutral position. Immediately after the dog clutch 29 is positioned at the reverse drive position, the marine vessel 1 is driven forward by inertia. A resistance (water pressure) that rotates the propeller 4 in the forward drive rotation direction is thus applied to the propeller 4. The resistance is transmitted to the crankshaft 23 via the propeller shaft 19, the forward-reverse switching mechanism 20, and the driveshaft 18. In this state, the dog clutch 29 is positioned at the reverse drive position and thus the resistance that makes the propeller 4 rotate in the forward drive rotation direction is transmitted to the crankshaft 23 as a force that rotates the crankshaft 23 in reverse.

In FIG. 7, the engine speed of the engine 5 decreases sharply when the shift position of the outboard motor 2 is switched from the neutral position to the reverse drive position and increases gradually after the shift position of the outboard motor 2 has been switched to the reverse drive position. Also, the oil pressure in the lubricating flow passage 52 decreases sharply at substantially the same timing as the engine speed of the engine 5 when the shift position of the outboard motor 2 is switched from the neutral position to the reverse drive position and increases in substantially the same manner as the engine speed of the engine 5 after the shift position of the outboard motor 2 has been switched to the reverse drive position. A minimum value of the oil pressure in the lubricating flow passage 52 when the shift position of the outboard motor 2 is switched from the neutral position to the reverse drive position is greater than the minimum oil pressure Pmin.

In FIG. 7, the engine speed of the engine 5 decreases sharply because the resistance (water pressure) applied to the propeller 4 is transmitted to the crankshaft 23 as the force that rotates the crankshaft 23 in reverse. Also, the oil pressure in the lubricating flow passage 52 did not decrease to the minimum oil pressure Pmin because the speed of the marine vessel 1 is low and thus the resistance applied to the propeller 4 is low and the crankshaft 23 continues to rotate in the one rotation direction D1 without rotating in reverse. The oil pressure not less than the minimum oil pressure Pmin is thus generated in the lubricating flow passage 52 even after the shift position of the outboard motor 2 has been switched to the reverse drive position, and the oil pressure varies in the same manner as the engine speed of the engine 5. It can thus be understood that, in FIG. 7, the crankshaft 23 continues to rotate in the fixed rotation direction and reverse rotation of the crankshaft 23 does not occur.

On the other hand, in FIG. 8, the engine speed of the engine 5 decreases sharply when the shift position of the outboard motor 2 is switched from the neutral position to the reverse drive position and increases sharply after the shift position of the outboard motor 2 has been switched to the reverse drive position. Although not apparent in FIG. 8, it is considered that the engine speed of the engine 5 decreases to zero instantaneously in this process. Also, the oil pressure in the lubricating flow passage 52 decreases sharply at substantially the same timing as the engine speed of the engine 5 when the shift position of the outboard motor 2 is switched from the neutral position to the reverse drive position. However, after the shift position of the outboard motor 2 has been switched to the reverse drive position, the oil pressure in the lubricating flow passage 52 does not vary greatly and is substantially fixed.

When the engine speed of the engine 5 (rotation speed of the crankshaft 23) in the one rotation direction D1 increases, the oil pressure in the lubricating flow passage 52 also increases. However, in FIG. 8, whereas the engine speed of the engine 5 increases sharply after the shift position of the outboard motor 2 has been switched to the reverse drive position, the oil pressure in the lubricating flow passage 52 does not increase. It can thus be understood that reverse rotation of the crankshaft 23 is occurring after the shift position of the outboard motor 2 has been switched to the reverse drive position.

Also, in FIG. 8, the oil pressure (post-switching oil pressure P2) in the lubricating flow passage 52 when the shift position of the outboard motor 2 is at the reverse drive position is less than the minimum oil pressure Pmin. If the crankshaft 23 rotates in the one rotation direction D1 after the shift position of the outboard motor 2 has been switched to the reverse drive position, the oil pressure in the lubricating flow passage 52 is not less than the minimum oil pressure Pmin. However, in FIG. 8, the post-switching oil pressure P2 is less than the minimum oil pressure Pmin. It can thus be understood from the value of the oil pressure as well that reverse rotation of the crankshaft 23 is occurring. Put in another way, the minimum oil pressure Pmin is set to a value that is less than the minimum oil pressure in the case where reverse rotation is not occurring as shown in FIG. 7 and is greater than the minimum oil pressure in the case where reverse rotation is occurring as shown in FIG. 8.

Figure 9:
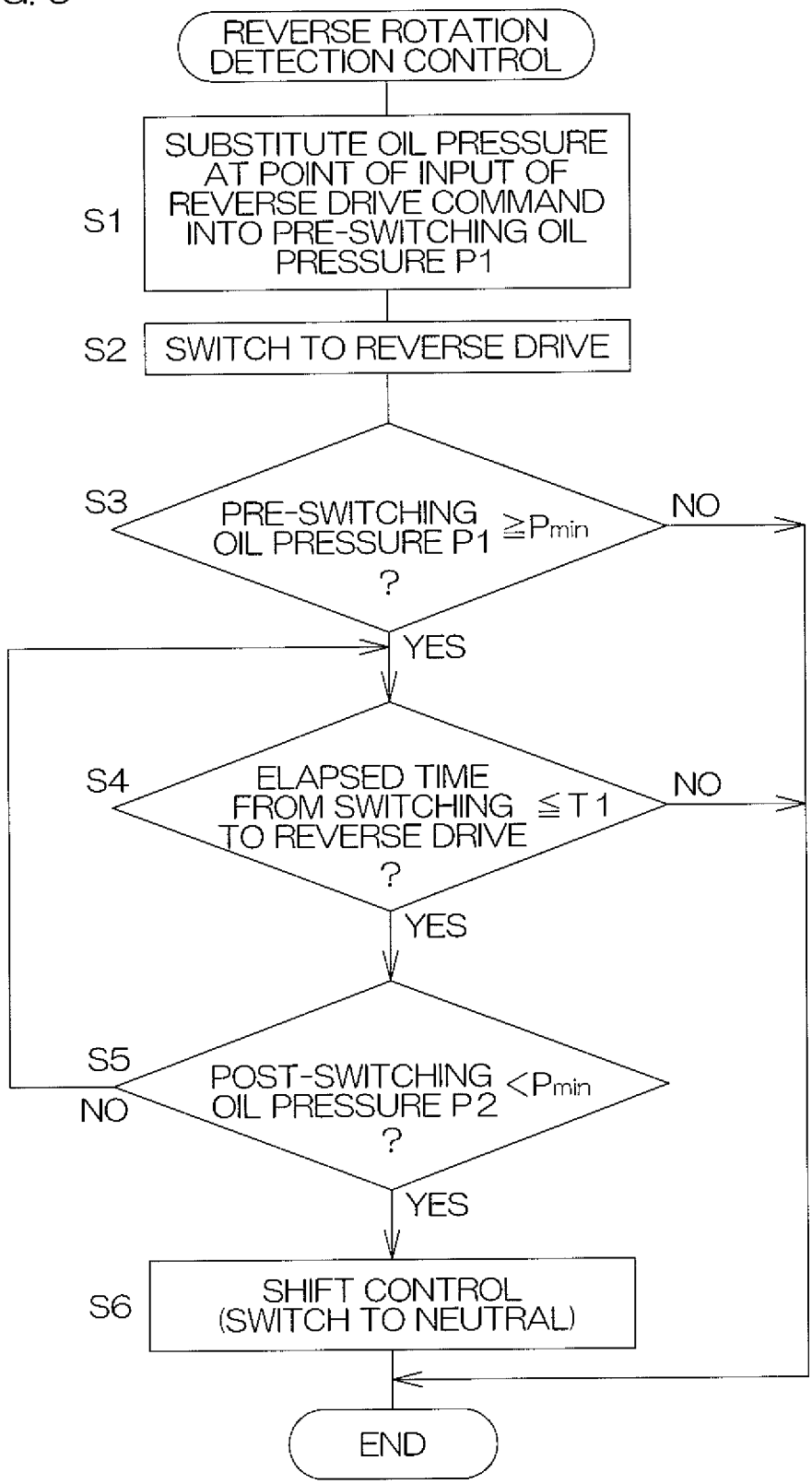
FIG. 9 is a flowchart for explaining a reverse rotation detection control according to a preferred embodiment of the present invention.

FIG. 9 is a flowchart for explaining a reverse rotation detection control according to a preferred embodiment of the present invention. An example of the reverse rotation detection control for detecting the reverse rotation of the crankshaft 23 shall now be described with reference to FIG. 3, FIG. 8, and FIG. 9.

When, in the state where the marine vessel 1 is being driven forward, the lever 10 of the remote control box 8 is moved from the forward drive output adjustment region Tf to the reverse drive output adjustment region Tr, a reverse drive switching command for switching the shift position of the outboard motor 2 to the reverse drive position is input into the ECU 6. The ECU 6 substitutes the oil pressure of the lubricating flow passage 52 at the point of input of the reverse drive switching command into the ECU 6 into a pre-switching oil pressure P1 (S1). Thereafter, the ECU 6 controls the shift actuator 32 to move the dog clutch 29 from the forward drive position to the reverse drive position via the neutral position (S2). The shift position of the outboard motor 2 is thereby switched from the forward drive position to the reverse drive position.

The ECU 6 then judges whether or not the pre-switching oil pressure P1 is not less than the minimum oil pressure Pmin (S3). If, at this point, the pre-switching oil pressure P1 is less than the minimum oil pressure Pmin (in the case of No at S3), the ECU 6 ends the reverse rotation detection control. That is, the pre-switching oil pressure P1 is the oil pressure in the lubricating flow passage 52 when the crankshaft 23 is rotating in the one rotation direction D1 and thus in the case where the pre-switching oil pressure P1 is less than the minimum oil pressure Pmin, there is a possibility that an abnormality is occurring in at least one component among the oil pressure detecting device 54, the oil pump 53, and the lubricating flow passage 52. The ECU 6 thus judges that an abnormality is occurring in the oil pressure detecting device 54, etc., and ends the reverse rotation detection control. On the other hand, if the pre-switching oil pressure P1 is not less than the minimum oil pressure Pmin (in the case of Yes at S3), the ECU 6 judges, by means of a timer 6*a* (see FIG. 3), whether or not a time elapsed from the switching of the shift position of the outboard motor 2 to the reverse drive position is within a predetermined time T1 (for example, within 0.5 seconds) (S4).

If the elapsed time exceeds the predetermined time T1 (in the case of No at S4), the ECU 6 ends the reverse rotation detection control. Also, if the elapsed time is within the predetermined time T1 (in the case of Yes at S4), the ECU 6 judges whether or not the post-switching oil pressure P2, which is the oil pressure in the lubricating flow passage 52 after the shift position of the outboard motor 2 has been switched to the reverse drive position, is less than the minimum oil pressure Pmin (S5). That is, the ECU 6 judges whether or not the post-switching oil pressure P2 is less than the minimum oil pressure Pmin immediately after the shift position of the outboard motor 2 has been switched to the reverse drive position.

If the post-switching oil pressure P2 is not less than the minimum oil pressure Pmin (in the case of No at S5), the ECU 6 judges again whether or not the time elapsed from the switching of the shift position of the outboard motor 2 to the reverse drive position is within the predetermined time T1 (returns to S4). Also, if the post-switching oil pressure P2 is less than the minimum oil pressure Pmin (in the case of Yes at S5), the ECU 6 judges that the crankshaft 23 is rotating in reverse or is at a point immediately before rotating in reverse and executes a shift control to switch the shift position of the outboard motor 2 from the reverse drive position to the neutral position (S6). Mechanical coupling of the crankshaft 23 and the propeller 4 is thereby cut off and the resistance (water pressure) applied to the propeller 4 is prevented from being transmitted to the crankshaft 23. Reverse rotation of the crankshaft 23 is thus prevented.

As described above, with the present preferred embodiment, when the engine 5 is rotating the crankshaft 23 in the one rotation direction D1, oil is supplied from the oil pump 53 to the lubricating flow passage 52 and the oil pressure corresponding to the rotation speed of the crankshaft 23 is generated in the lubricating flow passage 52. On the other hand, when the crankshaft 23 is not rotating and when the crankshaft 23 is rotating in reverse, oil is not supplied from the oil pump 53 to the lubricating flow passage 52. Thus, when the crankshaft 23 is not rotating and when the crankshaft 23 is rotating in reverse, the oil pressure in the lubricating flow passage 52 is less than the minimum oil pressure Pmin. Thus, when the rotation direction of the crankshaft 23 changes from the one rotation direction D1 to the other rotation direction (direction opposite to the one rotation direction D1), the oil pressure in the lubricating flow passage 52 changes from a value not less than the minimum oil pressure Pmin to a value less than the minimum oil pressure Pmin.

Based on the variation of the oil pressure in the lubricating flow passage 52, the ECU 6 can detect a state immediately before the crankshaft 23 rotates in reverse. Also, based on the oil pressure in the lubricating flow passage 52, the ECU 6 can detect the reverse rotation of the crankshaft 23 from the point immediately after the crankshaft 23 rotates in reverse. The reverse rotation of the crankshaft 23 is thereby detected immediately. In the case where the ECU 6 judges that the crankshaft 23 is about to rotate in reverse or the crankshaft 23 is rotating in reverse, the ECU 6 performs the shift control as the reverse rotation prevention control and switches the shift position of the outboard motor 2 from the reverse drive position to the neutral position. The mechanical coupling of the crankshaft 23 and the propeller 4 is thereby cut off and the force applied to the propeller 4 (the force that makes the crankshaft 23 rotate in reverse) is prevented from being transmitted to the crankshaft 23. Reverse rotation of the crankshaft 23 is thus prevented. The water in the exhaust passage 34 is thereby prevented from being sucked into the interior of the engine 5 by the reverse rotation of the crankshaft 23. Further, the reverse rotation of the crankshaft 23 is detected using a device (oil pressure detecting device 54) that is ordinarily provided in the outboard motor 2 and thus an increase in the number of parts of the outboard motor 2 is prevented.

Also, with the present preferred embodiment, the ECU 6 judges whether or not the post-switching oil pressure P2 is less than the minimum oil pressure Pmin immediately after the shift position of the outboard motor 2 has been switched from the forward drive position to the reverse drive position. Specifically, the ECU 6 makes the judgment within the predetermined time T1 (for example, within 0.5 seconds) from the point at which the shift position of the outboard motor 2 is switched to the reverse drive position. The reverse rotation of the crankshaft 23 is thereby detected immediately. Also, the reverse rotation prevention control is not performed after the predetermined time T1 has elapsed from the switching of the shift position of the outboard motor 2 to the reverse drive position. Thus, even in a case where the oil pressure decreases temporarily due to some reason during ordinary running of the marine vessel 1 (when the marine vessel 1 is being driven forward or in reverse at a predetermined speed), the reverse rotation prevention control is prevented from being performed erroneously.

Although preferred embodiments of the present invention have been described above, the present invention is not restricted to the contents of the above-described preferred embodiments and various modifications are possible within the scope of the claims.

For example, with the preferred embodiments described above, a case where a single outboard motor 2 is provided in the marine vessel 1 was described. However, a plurality of outboard motors 2 may be provided in the marine vessel 1. Also, the marine vessel propulsion apparatus is not restricted to being an outboard motor and may instead be an inboard motor, an inboard/outboard motor, or other type of marine vessel propulsion apparatus.

Also, with the preferred embodiments described above, a case where the ECU 6 detects the reverse rotation of the crankshaft 23 based on the oil pressure in the lubricating flow passage 52 was described. However, the ECU 6 may instead detect the reverse rotation of the crankshaft 23 based on the oil pressure in the lubricating flow passage 52 and the engine speed of the engine 5.

Figure 10:
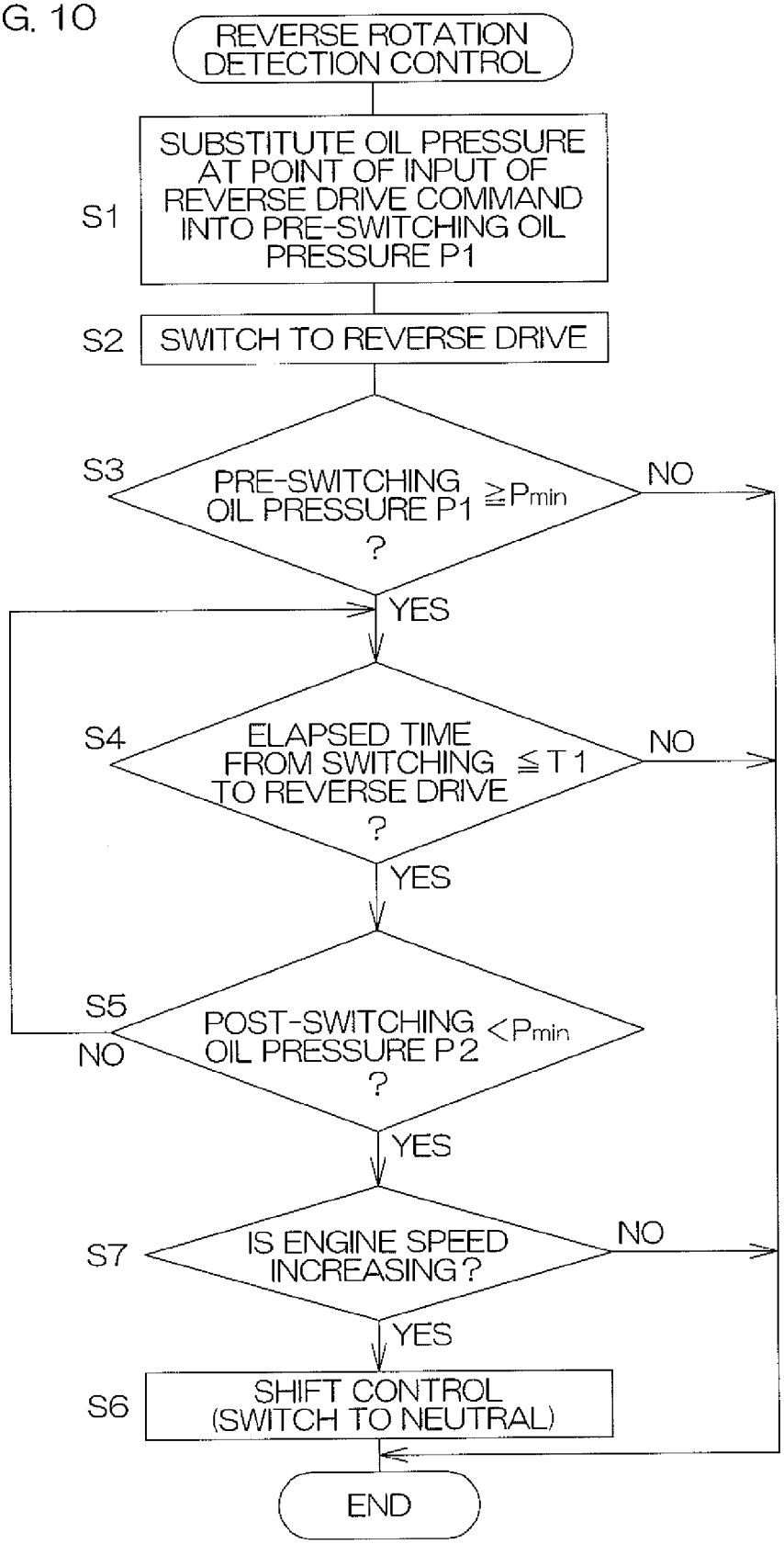
FIG. 10 is a flowchart for explaining a reverse rotation detection control according to another preferred embodiment of the present invention.

Specifically, for example as shown in FIG. 10, in the case where the post-switching oil pressure P2 is less than the minimum oil pressure Pmin (in the case of Yes at S5), the ECU 6 may judge whether or not the engine speed of the engine 5 is increasing after the shift position of the outboard motor 2 has been switched from the forward drive position to the reverse drive position (S7). The shift control may be performed if the engine speed of the engine 5 is increasing (in the case of Yes at S7) (S6).

When, in the state where the engine 5 is rotating the crankshaft 23 in the one rotation direction D1, the rotation speed of the crankshaft 23 increases, the flow rate of the oil supplied from the oil pump 53 into the lubricating flow passage 52 increases and the oil pressure in the lubricating flow passage 52 increases. Thus, if the crankshaft 23 is not rotating in reverse, when the rotation speed of the crankshaft 23 increases after the shift position of the outboard motor 2 has been switched from the forward drive position to the reverse drive position, the post-switching oil pressure P2 also increases (see FIG. 7). That is, in the case where the crankshaft 23 is rotating in reverse, the post-switching oil pressure P2 is less than the minimum oil pressure Pmin even if the rotation speed of the crankshaft 23 increases after the shift position of the outboard motor 2 has been switched from the forward drive position to the reverse drive position (see FIG. 8). In the flowchart of FIG. 10, the reverse rotation of the crankshaft 23 is detected based on the engine speed of the engine 5 in addition to the oil pressure of the lubricating flow passage 52. Reverse rotation of the crankshaft 23 is thereby detected more reliably.

Also, in the preferred embodiments described above, a case was described where when the reverse rotation of the crankshaft 23 is detected, the shift control to switch the shift position of the outboard motor 2 from the reverse drive position to the neutral position is performed as the reverse rotation prevention control. However, a combustion stopping control to stop the combustion in the engine 5 when the reverse rotation of the crankshaft 23 is detected may be performed instead as the reverse rotation prevention control.

Specifically, the ECU 6 may control the ignition coil 45 (see FIG. 4) to make the engine 5 misfire or control the fuel injector 47 (see FIG. 4) to stop the injection of fuel. The crankshaft 23 that is rotating in reverse is thereby prevented from being driven in the direction opposite to the one rotation direction D1 by the engine 5. The combustion stopping control may be performed in combination with the shift control or may be performed by itself.

Also, with the preferred embodiments described above, the case where the remote control box 8 and the ECU 6 are connected electrically and the ECU 6 controls the shift actuator 32 of the forward-reverse switching mechanism 20 in accordance with the operation of the lever 10 was described. However, the remote control box 8 and the forward-reverse switching mechanism 20 may instead be connected mechanically and the shift position of the outboard motor 2 may be switched mechanically in accordance with the operation of the lever 10. That is, the shift actuator 32 does not have to be provided. In this case, when the ECU 6 detects the reverse rotation of the crankshaft 23, the combustion stopping control may be performed as the reverse rotation prevention control in place of the shift control executed by the ECU 6 controlling the shift actuator 32.

Also, with the preferred embodiments described above, the case where the reverse rotation of the crankshaft 23 is detected based on the oil pressure of the lubricating flow passage 52 was described. However, the ECU 6 may instead detect the reverse rotation of the crankshaft 23 based on the water pressure in the water jacket 76. That is, the water pump 74 supplies the cooling water to the water jacket 76 when the crankshaft 23 is rotating in the one rotation direction D1 and thus the rotation state of the crankshaft 23 can be detected based on the water pressure in the water jacket 76. However, in the preferred embodiments described above, a passage length for cooling water from the water pump 74 to the water pressure detecting device 77 is longer than a passage length for oil from the oil pump 53 to the oil pressure detecting device 54, and thus when the rotation state of the crankshaft 23 changes, the oil pressure in the lubricating flow passage 52 changes more quickly than the water pressure in the water jacket 76. That is, the oil pressure in the lubricating flow passage 52 has a better response performance than the water pressure in the water jacket 76. It is thus more preferable to detect the reverse rotation of the crankshaft 23 based on the oil pressure in the lubricating flow passage 52, as in the preferred embodiments described above. This is because in the preferred embodiments described above, the water pressure detecting device 77 is provided for a purpose of notifying the detected water pressure by a meter, etc., to the marine vessel operator and thereby notifying that the cooling water is supplied to the engine, etc.

With specific reference to the response performance, as shown in FIG. 7, the water pressure in the water jacket 76 is substantially fixed before and after the shift position of the outboard motor 2 is switched from the neutral position (N) to the reverse drive position (R) and decreases slightly immediately after the engine speed of the engine 5 begins to decrease sharply. That is, whereas the oil pressure in the lubricating flow passage 52 decreases sharply at substantially the same timing as the engine speed of the engine 5, the water pressure in the water jacket 76 decreases slightly with a delay with respect to the decrease of the engine speed of the engine 5. Further, a decrease amount of the water pressure is less than a decrease amount of the oil pressure.

Meanwhile, in FIG. 8, the water pressure in the water jacket 76 continues to decrease gradually in accordance with the switching of the shift position of the outboard motor 2 from the neutral position (N) to the reverse drive position (R) and becomes substantially fixed after the shift position of the outboard motor 2 has been switched to the neutral position (N) again. However, unlike the oil pressure in the lubricating flow passage 52, the water pressure in the water jacket 76 only continues to decrease gradually and does not decrease sharply as does the engine speed of the engine 5.

Thus, in the preferred embodiments described above, the oil pressure in the lubricating flow passage 52 has a better response performance than the water pressure in the water jacket 76. It is thus preferable, as in the preferred embodiments described above, to detect the reverse rotation of the crankshaft 23 based on the oil pressure in the lubricating flow passage 52. However, the response performance of water pressure increases if a high-precision water pressure sensor is used as the water pressure detecting device 77. Thus, in a preferred embodiment, a high-precision water pressure sensor may be used as the water pressure detecting device 77. By this arrangement, the reverse rotation of the crankshaft 23 can be detected based on the water pressure of the water jacket 76 in the same manner as in the case of detecting the reverse rotation of the crankshaft 23 based on the oil pressure in the lubricating flow passage 52.

Also, in a preferred embodiment, a sensor 78, indicated by alternate long and two short dashed lines in FIG. 3, may be disposed near a discharge port of the water pump 74. The sensor 78 may be a flow rate sensor arranged to measure the flow rate of the cooling water discharged from the water pump 74 or a flow velocity sensor arranged to measure the flow velocity of the cooling water discharged from the water pump 74. The water pump 74 is driven by the engine 5 and thus the flow velocity and the flow rate of the cooling water discharged from the water pump 74 increase and decrease with the engine speed of the engine 5. Also, the flow velocity and the flow rate of the cooling water discharged from the water pump 74 vary at the same timing as the engine speed of the engine 5. Thus, by detecting the flow velocity or the flow rate of the cooling water near the discharge port of the water pump 74, the reverse rotation of the crankshaft 23 can be detected based on the flow velocity or the flow rate of the cooling water in the same manner as in the case of detecting the reverse rotation of the crankshaft 23 based on the oil pressure in the lubricating flow passage 52.

Likewise, the oil pump 53 is driven by the engine 5 and thus the flow velocity and the flow rate of the oil discharged from the oil pump 74 increase and decrease with the engine speed of the engine 5. Also, the flow velocity and the flow rate of the oil discharged from the oil pump 53 vary at the same timing as the engine speed of the engine 5. Thus, in a preferred embodiment, a sensor 79, indicated by alternate long and two short dashed lines in FIG. 5, may be disposed near the discharge port of the oil pump 53. The sensor 79 may be a flow rate sensor arranged to measure the flow rate of the oil discharged from the oil pump 53 or a flow velocity sensor arranged to measure the flow velocity of the oil discharged from the oil pump 53. By this arrangement, the reverse rotation of the crankshaft 23 can be detected based on the flow velocity or the flow rate of the oil in the same manner as in the case of detecting the reverse rotation of the crankshaft 23 based on the oil pressure in the lubricating flow passage 52.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2010-143143 filed in the Japan Patent Office on Jun. 23, 2010, and the entire disclosure of this application is incorporated herein by reference.

What is claimed is:

1. A marine vessel propulsion apparatus comprising:

an engine including a rotatably arranged crankshaft, the engine arranged to rotate a propeller by rotating the crankshaft in one rotation direction;

a rotation speed detecting device arranged to detect a rotation speed of the crankshaft;

a forward-reverse switching mechanism arranged to transmit the rotation of the crankshaft to the propeller, the forward-reverse switching mechanism arranged to be switched among a forward drive state in which the propeller is rotated in a forward drive rotation direction, a reverse drive state in which the propeller is rotated in a reverse drive rotation direction, and a neutral state in which a transmission of rotation between the crankshaft and the propeller is cut off;

a shift position detecting device arranged to detect which state among the forward drive state, the reverse drive state, and the neutral state the forward-reverse switching mechanism is in;

a liquid supplying device arranged to be driven by the engine and to supply a liquid to the engine;

a flow passage arranged to be supplied with the liquid from the liquid supplying device when the crankshaft is rotating in the one rotation direction;

a physical quantity detecting device arranged to detect, in the flow passage, a physical quantity of the liquid supplied from the liquid supplying device to the flow passage; and a controller arranged to acquire detection values of the rotation speed detecting device, the shift position detecting device, and the physical quantity detecting device, the controller executes a reverse rotation prevention control to control at least one of either the engine or the forward-reverse switching mechanism to prevent reverse rotation of the crankshaft in a case where a post-switching physical quantity, which is the physical quantity of the liquid in the flow passage after the forward-reverse switching mechanism has been switched from the forward drive state to the reverse drive state in a state where the crankshaft is rotating, is less than a predetermined first value.

2. The marine vessel propulsion apparatus according to claim 1, wherein the physical quantity detecting device includes a liquid pressure detecting device arranged to detect, in the flow passage, a pressure of the liquid supplied from the liquid supplying device to the flow passage;

the post-switching physical quantity includes a post-switching liquid pressure, which is the pressure of the liquid in the flow passage after the forward-reverse switching mechanism has been switched from the forward drive state to the reverse drive state in the state where the crankshaft is rotating; and the predetermined first value includes a predetermined first liquid pressure.

3. The marine vessel propulsion apparatus according to claim 2, wherein the liquid supplying device includes an oil supplying device arranged to supply oil when driven by the engine;

the liquid pressure detecting device includes an oil pressure detecting device arranged to detect, in the flow passage, a pressure of the oil supplied from the oil supplying device to the flow passage;

the post-switching liquid pressure includes a post-switching oil pressure, which is the pressure of the oil in the flow passage after the forward-reverse switching mechanism has been switched from the forward drive state to the reverse drive state in the state where the crankshaft is rotating; and the predetermined first value includes a predetermined first oil pressure.

4. The marine vessel propulsion apparatus according to claim 2, wherein the liquid supplying device includes a water supplying device arranged to supply water when driven by the engine;

the liquid pressure detecting device includes a water pressure detecting device arranged to detect, in the flow passage, a pressure of the water supplied from the water supplying device to the flow passage;

the post-switching liquid pressure includes a post-switching water pressure, which is the pressure of the water in the flow passage after the forward-reverse switching mechanism has been switched from the forward drive state to the reverse drive state in the state where the crankshaft is rotating; and the predetermined first value includes a predetermined first water pressure.

5. The marine vessel propulsion apparatus according to claim 3, wherein the predetermined first oil pressure is a minimum value of the oil pressure in the flow passage when the flow passage is filled with the oil.

6. The marine vessel propulsion apparatus according to claim 5, wherein the flow passage includes a discharge port from which the oil supplied from the oil supplying device is discharged; and the oil pressure detecting device is arranged to detect the oil pressure between the oil supplying device and the discharge port.

7. The marine vessel propulsion apparatus according to claim 1, wherein the controller is arranged and programmed to execute the reverse rotation prevention control in a case where a pre-switching physical quantity, which is the physical quantity of the liquid in the flow passage when the forward-reverse switching mechanism is in the forward drive state or the neutral state and the crankshaft is rotating, is not less than the predetermined first value and the post-switching physical quantity is less than the predetermined first value.

8. The marine vessel propulsion apparatus according to claim 1, wherein the controller includes a timer arranged to measure time; and the controller is arranged and programmed to execute the reverse rotation prevention control only when an elapsed time from the switching of the forward-reverse switching mechanism from the forward drive state to the reverse drive state is not more than a predetermined time.

9. The marine vessel propulsion apparatus according to claim 1, wherein the liquid supplying device is arranged such that a flow rate of the liquid supplied into the flow passage increases with an increase in the rotation speed of the crankshaft; and the controller is arranged and programmed to execute the reverse rotation prevention control in a case where, after the forward-reverse switching mechanism has been switched from the forward drive state to the reverse drive state, the rotation speed of the crankshaft is increasing and the post-switching physical quantity is less than the predetermined first value.

10. The marine vessel propulsion apparatus according to claim 1, wherein the reverse rotation prevention control includes a shift control to control the forward-reverse switching mechanism to switch the forward-reverse switching mechanism from the reverse drive state to the neutral state.

* * * * *